US007566842B2

(12) United States Patent
Hunger et al.

(10) Patent No.: US 7,566,842 B2
(45) Date of Patent: Jul. 28, 2009

(54) SWITCHING CHAMBER AND HEAVY-DUTY CIRCUIT BREAKER

(75) Inventors: Olaf Hunger, Schaffhausen (CH); Max Claessens, Gebenstorf (CH); Martin Holstein, Baden-Rütihof (CH); Johan Abrahamsson, Wettingen (CH); Martin Kriegel, Unterehrendingen (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/709,819

(22) Filed: Feb. 23, 2007

(65) Prior Publication Data

US 2007/0205182 A1 Sep. 6, 2007

Related U.S. Application Data

(63) Continuation of application No. PCT/CH2005/000433, filed on Jul. 22, 2005.

(30) Foreign Application Priority Data

Aug. 23, 2004 (EP) ..... 04405527

(51) Int. Cl.
*H01H 33/02* (2006.01)

(52) U.S. Cl. ..... 218/78; 218/14; 218/84; 218/154

(58) Field of Classification Search ..... 218/7, 218/14, 17, 19, 53, 54, 62–64, 72–74, 78, 218/84, 120, 140, 153, 154
See application file for complete search history.

(56) References Cited

U.S. PATENT DOCUMENTS 5,293,014 A * 3/1994 Perret ..... 218/57
5,902,978 A * 5/1999 Zehnder et al. ..... 218/57
6,013,888 A * 1/2000 Thuries ..... 218/14
6,429,394 B2 * 8/2002 Hunger et al. ..... 218/155
6,489,581 B2 * 12/2002 Ozil et al. ..... 218/61

FOREIGN PATENT DOCUMENTS

DE 100 03 359 C1 7/2001
EP 1 211 706 A1 6/2002
WO WO 00/52721 A1 9/2000

OTHER PUBLICATIONS

International Search Report.
Translation of the International Preliminary Examination Report for PCT/CH2005/000433.

* cited by examiner

*Primary Examiner*—Elvin G Enad
*Assistant Examiner*—Marina Fishman
(74) *Attorney, Agent, or Firm*—Buchanan Ingersoll & Rooney PC

(57) ABSTRACT

The switching chamber for a heavy-duty circuit breaker has a first arcing contact piece, a second arcing contact piece, a heating chamber, and an insulating nozzle. The first or second arcing contact piece can be moved by means of a drive. The heating chamber is used for temporarily storing quenching gas heated by an arc that may burn between the contact pieces. An insulating nozzle has a throat that is connected to the heating chamber, and which is used for guiding a quenching gas flow. During an opening operation, the two arcing contact pieces reach a maximum relative speed that is at least 1.3 times as great as a relative speed of the two arcing contact pieces. The relative speed being required for capacitive switching.

21 Claims, 2 Drawing Sheets

SWITCHING CHAMBER AND HEAVY-DUTY CIRCUIT BREAKER

TECHNICAL FIELD

The invention relates to the field of high-voltage circuit breaker technology. It relates to a switching chamber for a heavy-duty circuit breaker and to a heavy-duty circuit breaker as well as to a method for opening a switching chamber as claimed in the pre-characterizing clause of the independent patent claims.

PRIOR ART

The prior art has disclosed heavy-duty circuit breakers which can be filled with a quenching gas, having a switching chamber which has two arcing contact pieces, of which at least one can be moved by means of a drive. After a contact separation, an arc burns between the two arcing contact pieces. A heating chamber is provided for temporarily storing quenching gas heated by the arc. An insulating nozzle has a throat, which is connected to the heating chamber, for guiding a quenching gas flow. As a result, blowing of the arc is achieved which shall quench the arc, with the result that a current flowing through the heavy-duty circuit breaker can be switched off.

After the contact separation, a relative movement of the two arcing contact pieces takes place in order to distance them quickly from one another since, owing to the so-called recovery voltage arising directly after arc quenching, restriking can otherwise occur. If restriking occurs, switching has not taken place.

This so-called capacitive switching therefore requires a high relative speed of the two arcing contact pieces. A (minimum) relative speed of the two arcing contact pieces which is required for capacitive switching can be determined experimentally or by model calculations.

In heavy-duty circuit breakers and switching chambers known from the prior art, the relative speed of the two arcing contact pieces is selected such that it corresponds to the minimum requirements for capacitive switching, possibly with a safety margin of a few percent.

Since in the case of the heavy-duty circuit breakers known from the prior art capacitive switching places the highest demands on the relative speed of the two arcing contact pieces, no notably higher relative speeds have been realized since this would have required a more complex design of the heavy-duty circuit breaker and in particular correspondingly more powerful drives and damping devices, without resulting in any identifiable advantage.

Typical maximum relative speeds of the arcing contact pieces are between 5 m/s and 9 m/s.

EP 1 211 706 A1 has disclosed a heavy-duty circuit breaker having two moveable arcing contact pieces, a maximum speed ratio of the two contact pieces with opposite movement directions of 1:1.6 to 1:1.7 being achieved.

In switching chambers and heavy-duty circuit breakers of the type mentioned it is always desirable to achieve more powerful arc blowing.

The document DE 100 03 359 C1, for example, has disclosed a heavy-duty circuit breaker having two moveable arcing contact pieces and a heating chamber for temporarily storing quenching gas, which has been heated by an arc which may burn between the arcing contact pieces. The breaker has an insulating nozzle, which has a throat for the purpose of guiding a quenching gas flow, which throat in turn is connected to the heating chamber by means of a channel. At first, the two contact pieces move in opposite directions, in which case the contact separation takes place and the throat is at least partially blocked by the second of the two contact pieces.

While the throat is still at least partially closed by the second contact piece, a movement direction reversal of the second contact piece takes place. The second contact piece therefore then moves in the same direction as the first of the two contact pieces. As a result of the fact that the throat is still at least partially blocked by the second contact piece during the movement direction reversal, an increase in the quenching gas pressure in the heating chamber can be produced. As a result, more powerful arc blowing can be achieved.

DESCRIPTION OF THE INVENTION

The object of the invention is to provide an alternative possibility for producing particularly effective arc blowing.

This object is achieved by an apparatus and a method having the features of the independent patent claims.

A switching chamber according to the invention for a heavy-duty circuit breaker which can be filled with a quenching gas has a first arcing contact piece and a second arcing contact piece, of which at least one can be moved by means of a drive. An arc may burn between the arcing contact pieces. The switching chamber comprises a heating chamber for temporarily storing quenching gas heated by the arc and an insulating nozzle, which has a throat, which is connected to the heating chamber, for the purpose of guiding a quenching gas flow.

In accordance with a first aspect of the invention, during an opening operation, a maximum relative speed $v_{12,max}$ of the two arcing contact pieces in relation to one another is at least 1.3 times as great as a relative speed $v_{12,c}$ of the two arcing contact pieces which is required for capacitive switching. This first aspect of the invention can also be formulated such that the switching chamber according to the invention is designed such that, during an opening operation, a maximum relative speed $v_{12,max}$ of the two arcing contact pieces in relation to one another is at least 1.3 times as great as a relative speed $v_{12,c}$ of the two arcing contact pieces which is required for capacitive switching.

In particular, the switching chamber according to the invention can be designed such that, or the invention may consist in the fact that, during an opening operation, the maximum relative speed $v_{12,max}$ of the two arcing contact pieces in relation to one another is at least 1.5 times as great, advantageously at least 1.7 times as great, advantageously at least 1.9 times as great or even at least 2 times as great, as the relative speed $v_{12,c}$ of the two arcing contact pieces which is required for capacitive switching.

The speed $v_{12,c}$ is the minimum relative speed of the two arcing contact pieces which is required for capacitive switching, i.e. the smallest relative speed of the two arcing contact pieces which makes capacitive switching possible.

Another aspect of the invention may consist in the fact that, if the switching chamber is installed in a single-chamber heavy-duty circuit breaker, the following applies for the maximum relative speed $v_{12,max}$ of the two arcing contact pieces in relation to one another during an opening operation:

$$v_{12,max} \geqq 23 \times U_N \cdot p \cdot f / (E_{crit} \cdot p_0), \text{ in particular}$$

$$v_{12,max} \geqq 27 \times U_N \cdot p \cdot f / (E_{crit} \cdot p_0), \text{ advantageously}$$

$$v_{12,max} \geqq 31 \times U_N \cdot p \cdot f / (E_{crit} \cdot p_0), \text{ wherein}$$

$U_N$ is the rated voltage of the heavy-duty circuit breaker, p is the pole factor of the heavy-duty circuit breaker, $E_{crit}$ is the threshold field strength for discharges of the quenching gas, and $p_0$ is the filling pressure of the quenching gas, and f is the system frequency for which the switching chamber is designed. Formulated differently, the invention in terms of this other aspect may consist in the fact that the switching chamber is designed such that, if it is installed in a single-chamber heavy-duty circuit breaker, that which is mentioned above applies for the maximum relative speed $v_{12,max}$ of the two arcing contact pieces in relation to one another during an opening operation.

The equation $$v_{12,c} \approx k \times U_N \cdot p \cdot f / (E_{crit} \cdot p_0)$$

gives a good approximation of the minimum maximum speed between the two arcing contact pieces which is required for capacitive switching, wherein the factor k is typically between 16 and 18.5.

The mentioned equations/inequations for $v_{12,c}$ or $v_{12,max}$ also apply in the disclosed form to a heavy-duty circuit breaker which has precisely one corresponding switching chamber. In order to calculate $v_{12,c}$ or $v_{12,max}$ for a heavy-duty circuit breaker which has more than one switching chamber, another factor needs to be inserted into the equations (or the factor k is replaced by a factor k'), as a result of which the voltage shift for the heavy-duty circuit breaker (for example owing to capacitances connected in parallel with the switching chambers) is taken into account.

With $SF_6$ as the quenching gas, $E_{crit}$ is approximately 8900 kV/(bar·m). For other quenching gases such as $CF_4$ or mixtures of $SF_6$ and $N_2$, the corresponding $E_{crit}$ value can be taken from relevant text books. Typical system frequencies are 50 Hz and 60 Hz. Filling pressures $p_0$ are typically 4.3 bar or 6 bar or above. The pole factor p depends on the grounding conditions of the heavy-duty circuit breaker provided in the high-voltage system (see, for example, the standard IEC 62271-100) and is typically 1.4 or 1.2, occasionally also above 1.4. Typical heavy-duty circuit breaker rated voltages $U_N$ are of the order of magnitude of 123 kV or 365 kV.

In another aspect, the invention may consist in the fact that the following applies for the maximum relative speed $v_{12,max}$ of the two arcing contact pieces in relation to one another during an opening operation:

$v_{12,max} \geqq 13$ m/s, advantageously $v_{12,max} \geqq 15$ m/s, in particular $v_{12,max} \geqq 17$ m/s, particularly advantageously $v_{12,max} \geqq 19$ m/s.

Formulated differently, the invention in terms of this other aspect may consist in the fact that the switching chamber is designed such that that which has been mentioned above applies for the maximum relative speed $v_{12,max}$ of the two arcing contact pieces in relation to one another during an opening operation.

The invention makes it possible to produce an arc having a very large extent within a very short period of time. During a substantial part of the arcing time (arc burning period), owing to the arc, material from the insulating nozzle can advantageously be vaporized along a large proportion of the throat, advantageously along the entire length of the throat. A large surface, in particular the entire inner surface of the throat, can therefore be used for producing (vaporizing) arc-quenching material over a relatively long period of time. As a result, a large quantity of arc-quenching material is produced, so that efficient arc blowing is achieved. Owing to the very fast relative movement, this large quantity of arc-quenching material can be produced even within a very short period of time, with the result that a very high quenching gas pressure can be produced and the pressure can be produced very quickly after the contact separation. As a result, very powerful arc blowing can be achieved. Very reliable switching, even of high short-circuit currents, can therefore be achieved.

Advantageously, the movement of the insulating nozzle is coupled, in particular rigidly coupled, to the movement of one of the two contact pieces (movement of the insulating nozzle and the associated contact piece at the same speed and in the same direction). Advantageously, the relative speed between the insulating nozzle and one of the two contact pieces meets one of the abovementioned conditions according to the invention for the maximum relative speed $v_{12,max}$ of the two contact pieces.

If the throat can be blocked at least partially by one of the two arcing contact pieces, which is referred to as the blocking contact piece and is moveable, the two arcing contact pieces, advantageously up to at least the point in time at which the throat is released or unblocked by the blocking contact piece (i.e. at least until a quenching gas flow through the throat is made possible), have a relative speed which meets one of the abovementioned conditions for $v_{12,max}$. This relative speed may be the maximum relative speed $v_{12,max}$ of the arcing contact pieces or else a relative speed which is lower than $v_{12,max}$.

In another aspect, the invention may consist in the fact (that the switching chamber is designed such) that both arcing contact pieces are moveable, and that, during a phase of movement in opposite directions of the arcing contact pieces, a ratio $v1/v2$ of the speed $v1$ of the first arcing contact piece to the speed $v2$ of the second arcing contact piece of $v1/v2 \leqq 1:2.4$, in particular $v1/v2 \leqq 1:2.7$, $v1/v2 \leqq 1:2.8$ or $v1/v2 \leqq 1:3$, is achieved. Owing to such a speed ratio, a high relative speed of the arcing contact pieces can be reached. This is particularly advantageous when the mass to be moved by the first arcing contact piece is markedly (at least by a factor of 2 or 3 or 4 or more) greater than the mass to be moved by the second arcing contact piece.

If both arcing contact pieces are moveable, a first drive for driving the first arcing contact piece and a second drive for driving the second arcing contact piece are advantageously provided. In particular, the second drive (auxiliary drive) may be a gear which can be driven by the first drive. Advantageously, the insulating nozzle may furthermore be capable of being driven by means of the first drive.

In the case of two moveable arcing contact pieces, the switching chamber is advantageously designed such that, in a phase during a movement in the same direction of the arcing contact pieces, the following applies for the ratio $v1/v2$ of the speed $v1$ of the first arcing contact piece to the speed $v2$ of the second arcing contact piece:

$0.4 \leqq v1/v2 \leqq 1.2$, in particular $0.75 \leqq v1/v2 \leqq 1:1.15$.

Particularly advantageously, the speed ratio $v1/v2$ is between 0.9 and 1.1 or close to one or is essentially one.

In one advantageous embodiment, a compression chamber is provided the volume of which is reduced during an opening operation. The compression chamber may be identical to the heating chamber or different from the heating chamber, and in particular a valve may be provided between the compression chamber and the heating chamber. The breaker, or the switching chamber, may be in the form of a puffer circuit breaker or in the form of a self-blowing circuit breaker or in the form of a puffer circuit breaker/self-blowing circuit breaker hybrid.

The switching chamber can advantageously be designed such that, during an opening operation, after the contact separation and while a quenching gas flow along an axis through the throat in the direction of the second arcing contact piece is possible, a distance d, which is measured parallel to the axis, between the throat and the second arcing contact piece is selected such that the flow rate of the quenching gas flow is at a maximum in a region which is arranged, with respect to the axis, radially and laterally next to the second arcing contact piece and/or within the second arcing contact piece. The region may be continuous or comprise a plurality of subregions.

The distance d is a spacing. The distance d is of course measured between the mutually facing ends of the throat and the second contact piece, if the throat and the second contact piece are spaced apart from one another.

Owing to the mentioned selection of the distance d, optimization of the quenching gas flow, in particular in the region of the throat and the second contact piece, is achieved. The quenching gas flow is optimized to the extent that a particularly high breakdown strength is produced where a particularly high dielectric load is present. This advantageous effect is achieved by the described selection of the distance d, since a high quenching gas density can be achieved along the switching path, whereas a lower quenching gas density is present in the region to the side of (and/or within) the second contact piece, where the dielectric load is less.

Advantageously, the throat may be essentially in the form of a cylinder, and the switching chamber may be designed such that, during an opening operation, after the contact separation and during a quenching phase, in which a quenching gas flow along an axis through the throat in the direction of the second arcing contact piece is possible, a distance d, which is measured parallel to the axis, between the throat and the second arcing contact piece is selected such that $$d=D\times((1+b'\cdot\cos\alpha)^{1/2}-1)/(2\cdot\sin\alpha\cdot\cos\alpha)$$

applies. In this case, D is the diameter of the cylinder close to that end of the cylinder which faces the second arcing contact piece during the quenching phase, the angle $\alpha$ is equal to an opening angle $\alpha$ of an extended region adjoining the throat, and the following applies for the parameter $b':b'=b-F/F'$, where F' is the area of the cross-sectional area, which is arranged radially with respect to the axis, of an opening, which may be provided in the second contact piece, for quenching gas to flow away, and where the following applies for the parameter b:

$1.4\leqq b\leqq 4.5$, in particular $1.7\leqq b\leqq 4.0$, in particular $2.1\leqq b\leqq 3.5$, and particularly advantageously $2.2\leqq b\leqq 3.2$.

The throat is essentially cylindrical, and the second contact piece is advantageously likewise essentially cylindrical. The diameter of the respective cylinder (of the throat or of the second contact piece) does not need to be completely constant and can vary slightly. Deviations from a circular cross section to, for example, elliptical cross sections are possible. The throat (or else the second contact piece) may have another shape, advantageously an essentially prismatic shape, and is nevertheless referred to as essentially cylindrical. A corresponding radial dimension of the throat can then be taken as the diameter D. In particular, with a high degree of accuracy it is possible to take the diameter of a circle which has the same area as the throat close to the second contact piece.

The diameter of the cylinder or the radial dimension of the prism also does not need to be precisely constant. The variable relevant for determining d is the radial dimension at that end of the cylinder or prism which faces the second contact piece. These shapes are also included within the term "essentially cylindrical".

Owing to the described selection, which is dependent on the cylinder diameter, of the distance d, the mentioned advantageous flow rate condition is met for customary breaker geometries. If the distance d can be kept within a relatively narrow range of those specified for d, it can be ensured more easily that the advantageous quenching gas flow is maintained.

There is therefore a time span, referred to as the quenching phase, which comes after the contact separation and during which a quenching gas flow can take place through the throat in the direction of the second arcing contact piece (and effectively takes place in the event of switching). During such a time span, the distance d meets the mentioned condition. This condition states that the region in which the flow rate of the mentioned quenching gas flow, which is directed through the throat in the direction of the second contact piece, is at its greatest is arranged within the second contact piece and/or laterally next to the second contact piece.

While the throat is at least partially blocked by a contact piece, which can be referred to as the blocking contact piece, no (notable) quenching gas flow can take place through the throat.

The condition mentioned for the distance d is advantageously met during at least 10 ms, more advantageously during at least 20 ms, at least 35 ms or at least 50 ms during an opening operation.

The throat can also be referred to as the nozzle channel.

The contact separation means separation of a physical contact between the two arcing contact pieces 1 and 2.

Advantageously, the second arcing contact piece is in the form of a pin, in particular in the form of a solid pin.

In one preferred embodiment, the throat can be blocked at least partially by one of the two arcing contact pieces, which is referred to as the blocking contact piece and is moveable, and the switching chamber is designed such that, during an opening operation, there is a time span during which a movement direction of the blocking contact piece remains unchanged and the maximum relative speed $v_{12,max}$ of the two arcing contact pieces in relation to one another is reached. This time span advantageously lasts at least until the throat is no longer at least partially blocked by the blocking contact piece.

In this embodiment, after the contact separation, there is thus an uninterrupted movement of the blocking contact piece in one and the same direction, this movement lasting at least up until the throat is released by the blocking contact piece, and, (at some point) during this movement, the maximum relative speed $v_{12,max}$ of the two arcing contact pieces in relation to one another being reached. This ensures that, very quickly, a very large insulating nozzle surface is subjected to the arc. Advantageously, no movement direction reversal of the blocking contact piece takes place before the throat is released.

One particularly preferred embodiment is characterized by the fact that the throat can be blocked at least partially by one of the two arcing contact pieces, which is referred to as the blocking contact piece and is moveable, and (that the switching chamber is designed such) that, during an opening operation, a movement direction reversal of the at least one moveable arcing contact piece takes place, if the throat is no longer at least partially blocked by the blocking contact piece.

As a result, a large quantity of arc-quenching material can be produced within a short period of time after the contact separation. Also, it is possible to reduce the load of a damping device, which brakes the contact pieces, or to use a less complex damping device.

The movement direction reversal taking place once the throat has been released by the blocking contact piece furthermore also makes it possible to optimize the quenching gas flow close to the blocking contact piece. The distance between the two contact pieces, depending on the ratio of the speeds of the two contact pieces, can (easily) be increased or decreased in size or, particularly advantageously, kept essentially constant.

In particular, a distance between the blocking contact piece and the throat can also (easily) be increased or decreased in size or, particularly advantageously, kept essentially constant. If, for example, the movement of the insulating nozzle is coupled at a ratio of 1:1 (rigidly) to the movement of the first contact piece and the movement in the same direction (after the movement direction reversal) of the two contact pieces is likewise essentially equal in size, a predeterminable distance between the throat and the blocking contact piece can be kept essentially constant. In particular and very advantageously, one of the conditions mentioned further above for the distance d can also be met over a relatively long period of time.

Owing to the movement reversal, an initially antiparallel movement or movement in opposite directions of the two arcing contact pieces becomes a parallel movement or movement in the same direction of the two arcing contact pieces.

In particular if a gear, which is driven by the drive, is used as the auxiliary drive (second drive), in the case of the selection of a speed ratio v1/v2 of the speed v1 of the first arcing contact piece to the speed v2 of the second arcing contact piece of v1/v2≈1:1 given a movement of the contact pieces in the same direction, a constant distance between the contact pieces (and possibly also a constant distance between the throat and the blocking contact piece) can be achieved which even remains constant when the breaker movement is braked by a damping mechanism. It is thus also possible for the influence of return movement on the mentioned distances to be essentially eliminated. Return movement arises if the movement of a driven contact piece is impeded by quenching gas in the heating chamber, with the result that an undesired movement direction reversal of at least one of the contact pieces takes place.

Owing to the movement direction reversal produced in a targeted manner by means of the drives, in such a heavy-duty circuit breaker or breaker pole effective monitoring of the distances between the contact pieces and the throat/contact piece distance can therefore be achieved such that desired flow conditions, in particular close to the blocking contact piece, can be set and maintained even in different switching cases. Optimization of the quenching gas flow in the vicinity of the contact pieces is made possible.

A heavy-duty circuit breaker according to the invention has at least one switching chamber according to the invention and has the corresponding advantages.

The method according to the invention for opening a switching chamber for a heavy-duty circuit breaker, which can be filled with a quenching gas, having a first arcing contact piece and having a second arcing contact piece, having at least one drive and having an insulating nozzle, which has a throat, has the steps that at least one of the two arcing contact pieces is moved by means of the drive, that a contact separation takes place, and an arc burning between the arcing contact pieces is struck, by means of which arc quenching gas is heated, and that the heated quenching gas is temporarily stored and guided through the throat for the purpose of blowing the arc.

The method is characterized by the fact that, during an opening operation, a maximum relative speed $v_{12,max}$ of the two arcing contact pieces in relation to one another is reached which is at least 1.3 times, in particular 1.5 times, as great as a relative speed $v_{12,c}$ of the two arcing contact pieces which is required for capacitive switching. The advantages result from the advantages of the switching chamber.

The method according to the invention can also be regarded as a method for switching an electrical current by means of a switching chamber.

Advantageously, the two arcing contact pieces are arranged coaxially with respect to one another. The channel between the heating chamber and the throat can advantageously be in the form of an annular channel.

Typically, in an opening operation, first the rated current contact pieces are separated from one another so that the electrical current to be interrupted commutates to the arcing contact pieces. Then, the arcing contact pieces are separated, with the arc being struck.

Advantageously, one of the two arcing contact pieces, in particular the first arcing contact piece, may have an opening for accommodating the other arcing contact piece, which is advantageously in the form of a pin, in the closed breaker state and for quenching gas to flow away in the open breaker state. In particular, this arcing contact piece may be in the form of a tulip contact having a large number of contact fingers.

It is advantageous if the second arcing contact piece is in the form of a pin and is moveable, while the first contact piece has an opening for accommodating the second contact piece and is moveable or immoveable. Heavy-duty circuit breakers and switching chambers within the meaning of this application are in particular those which are designed for rated voltages of typically at least approximately 72 kV.

The arc in a switching chamber according to the invention generally burns close to the axis and is essentially stationary. In general, the base points of the arc are fixed to the ends of the arcing contact pieces.

Further preferred embodiments and advantages are apparent from the dependent patent claims and the figures.

BRIEF DESCRIPTION OF THE DRAWINGS

The subject matter of the invention will be explained in more detail below with reference to preferred exemplary embodiments, which are illustrated in the attached drawings, in which, schematically.

Figure 1:
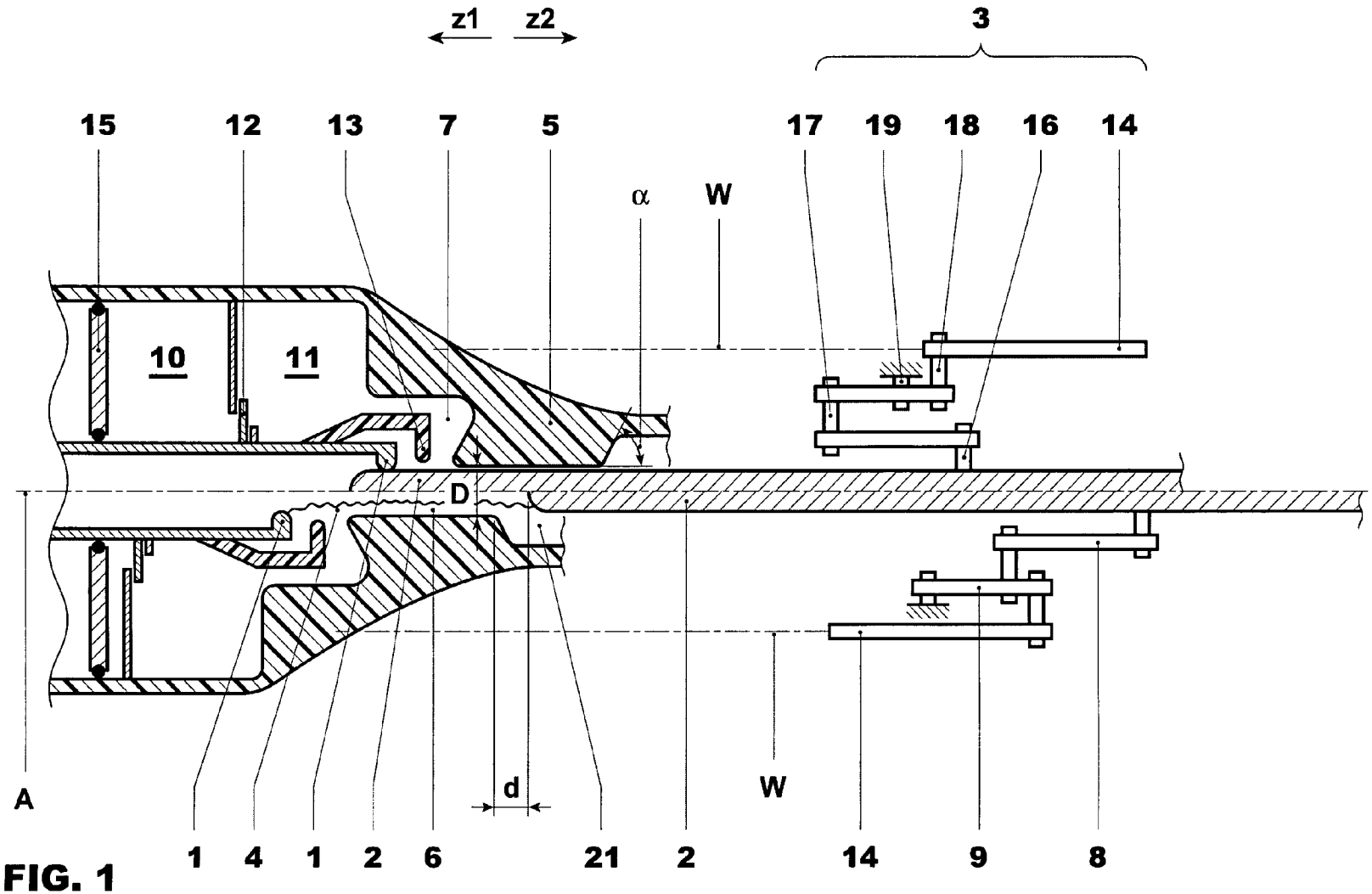
FIG. 1 shows a switching chamber according to the invention having two moveable arcing contact pieces in the open and in the closed state, in section, with a plan view of the gear.

The reference symbols used in the drawings and their significance are listed by way of summary in the list of reference symbols. In principle, identical or functionally identical parts in the figures are provided with the same reference symbols. The exemplary embodiments described are examples of the subject matter of the invention and have no restrictive effect.

APPROACHES TO IMPLEMENTING THE INVENTION

FIG. 1 shows schematically a switching chamber according to the invention or a single-chamber heavy-duty circuit breaker according to the invention in the open state (lower half of the figure) and in the closed state (upper half of the figure). In the right-hand part of the figure, a plan view of a gear 3 is illustrated schematically. The heavy-duty circuit breaker filled with a quenching gas (for example $SF_6$ or a mixture of $N_2$ and $SF_6$) has a first moveable arcing contact piece 1, which can be driven by a drive (not illustrated). A suitable drive may be, for example, an electrodynamic drive or a stored-energy spring mechanism.

A second arcing contact piece 2 is driven by an auxiliary drive 3, which is implemented by the gear 3 driven by the drive. In the closed state of the breaker, the two arcing contact pieces 1, 2 touch one another. In addition, rated current contact pieces (not illustrated) may also be provided.

The first contact piece 1 is rigidly connected to an insulating nozzle 5 and an auxiliary nozzle 13. The insulating nozzle 5 has a throat 6, which is essentially cylindrical having a diameter D. A region 21, which has an extended diameter and has an opening angle α, adjoins the throat 6. The throat is connected to a heating chamber 11 by an annular channel 7. A compression chamber 10 is connected to the heating chamber 11 by a valve 12. The volume of the heating chamber can be changed by means of a piston 15, which is advantageously designed to be fixed.

The heavy-duty circuit breaker is essentially rotationally symmetrical with respect to an axis A, as a result of which axial directions z1 and z2, along which the arcing contact pieces move, and radial directions, at right angles thereto, are defined.

Figure 2:
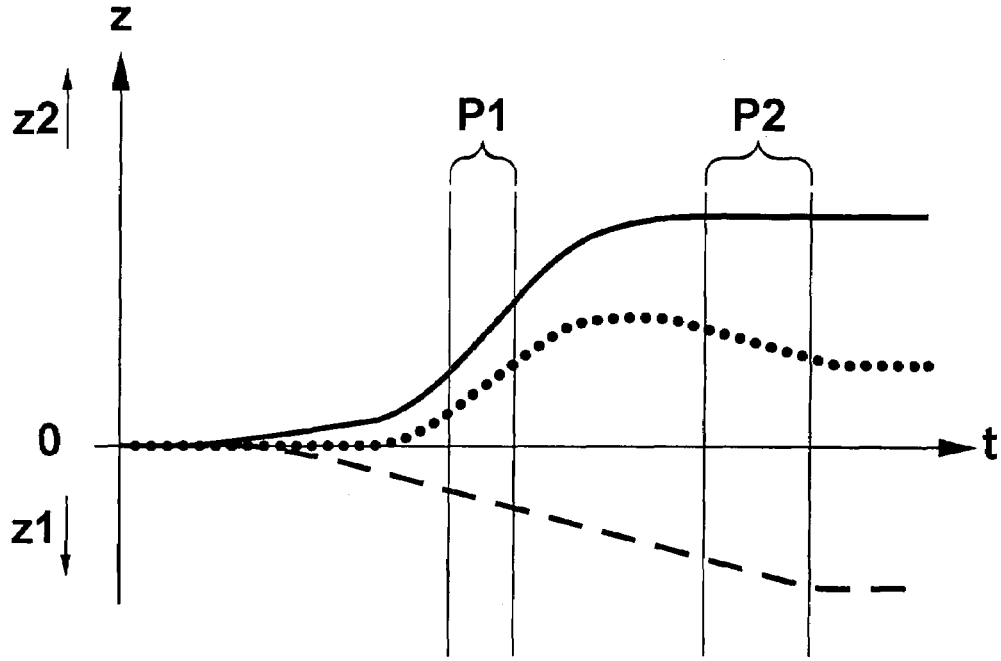
FIG. 2 shows a distance/time curve for an opening operation.

FIG. 2 illustrates, schematically, a distance/time graph (z/t curves) for the movement of the first contact piece 1 (dashed curve) and of the second contact piece 2 (dotted curve) and for the relative movement of the two contact pieces (continuous line).

Figure 3:
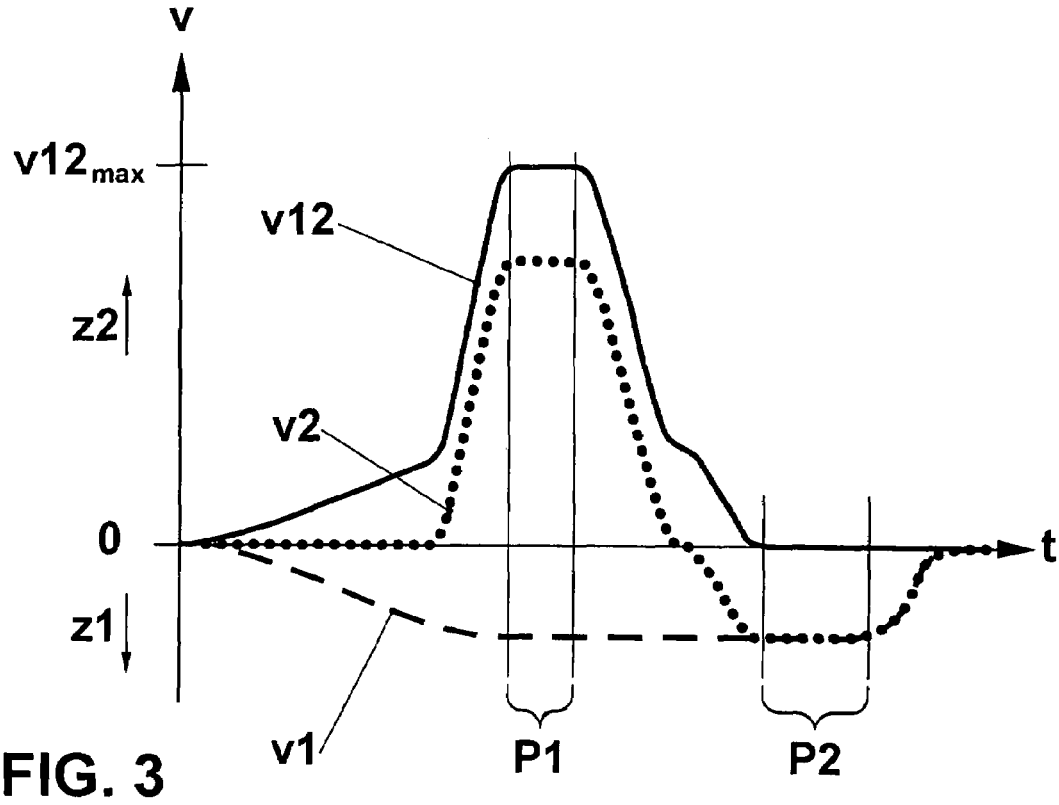
FIG. 3 shows a speed/time curve for an opening operation.

The corresponding speed/time curves (v/t curves) are illustrated schematically in FIG. 3. The speed v1 of the first contact piece 1 (dashed curve) and the speed v2 of the second contact piece 2 (dotted curve) and the relative speed v12 of the two contact pieces (continuous line) are illustrated.

During an opening operation for the purpose of interrupting a current flowing through the heavy-duty circuit breaker, initially the first arcing contact piece 1 and the insulating nozzle 5, the auxiliary nozzle 13 and the valve 12 move in the direction z1. With an optional delay, the second contact piece 2 moves in the direction z2. The mass to be moved directly by the drive is greater than the mass to be moved by the gear 3. It can therefore be expected that the second contact piece 2 will be accelerated until shortly before the maximum speed v1 is reached. Once it has reached its maximum speed, the first contact piece 1 remains at this speed until a braking operation at the end of the opening operation.

Owing to the fixed piston 15, the volume of the compression chamber is reduced, and the valve 12 allows quenching gas to flow into the heating chamber 10. Then, during a phase of high or maximum relative speed v12, the contact separation takes place, with an arc 4 being struck. It is possible that the contact separation takes place shortly (a few milliseconds) before or after the maximum relative speeds have been reached.

The arc 4 results in heating of the quenching gas and, in the throat 6, detaches wear material from the insulating nozzle 5. By means of the annular channel 7, an excess pressure is thus produced in the heating chamber 11. Above a pressure difference between the heating chamber 11 and the compression chamber 10 which can be predetermined by the valve 12, for example if a greater pressure prevails in the heating chamber 11 than in the compression chamber 10, the valve 12 closes. The quenching gas, which later flows out of the heating chamber 11 and possibly also out of the compression chamber 10 through the heating chamber 11 then through the channel 7 into the quenching path arranged between the two contact pieces 1, 2, is then used for quenching the arc 4.

Once that end of the second arcing contact piece 2 which faces the first arcing contact piece 1 has traversed the majority (approximately 80%) of the length of the throat 6 at the maximum speed v2 (and therefore during the presence of the maximum relative speed $v_{12,max}$ of the two arcing contact pieces), v2 is reduced again. The second contact piece 2 comes to a standstill and, once it has released the throat 6, moves in the direction z1 and therefore parallel to (in the same direction as) the first contact piece 1. After this movement direction reversal, the second contact piece 2 soon reaches the same speed as the first contact piece 1.

As soon as the throat 6 is no longer at least partially blocked by the second contact piece 2, quenching gas can flow away through the channel 7 not only through the tulip-shaped first contact piece 1 (in the direction z1), but also (to a notable degree) through the throat 6 and past the pin-shaped second contact piece 2 (in the direction z2).

Owing to the speed ratio v1/v2 of essentially 1:1 in the case of a movement in the same direction of the two contact pieces 1, 2, a distance d between the second contact piece 2, which is advantageously in the form of a pin, and the throat 6 can be kept essentially constant. This distance d is selected such that, in the event of a quenching gas flow through the throat 6 to the blocking contact piece 2 (in the direction z2), the maximum flow rate occurs laterally (i.e. radially) next to the blocking contact piece 2, and in particular not on the path between the two arcing contact pieces 1 and 2 (or radially adjacent to this path). As a result, particularly efficient arc blowing is achieved, and restriking of the arc is effectively suppressed. The distance d is selected as $d \approx (0.7 \pm 0.2) \times D$, wherein D is the diameter of the throat 6 (at its z2 end). If the opening angle α were less than 45°, the distance d would advantageously be selected approximately as $d \approx (0.7 \pm 0.2) \times D / \tan \alpha$.

If, owing to the gear 3, a speed ratio v1/v2 of 1:1 (after the movement direction reversal) is predetermined, the distance d and therefore also the corresponding flow conditions can be maintained even when the breaker enters the damping state, i.e. the contact pieces 1, 2 are braked by a damping mechanism. Towards the end of an opening operation, a return movement of the first contact piece 1 brought about by the pressure conditions in the heating chamber 11 and/or the compression chamber 10 also often results. Even in case of such a return movement, the distance d cannot change when selecting a speed ratio v1/v2 of 1:1. In this regard, optimum flow conditions can be maintained up to the end of the opening movement and, as a result, reliable arc quenching can be ensured without restriking. Owing to the speed ratio v1/v2 of 1:1, the distance between the two contact pieces 1 and 2 is also constant, with the result that the electrical field distribution can be kept constant.

Owing to a speed ratio v1/v2 of approximately 1:1 after the movement direction reversal, it is possible to reduce the load of the damping device or to use a less complex damping device, since a longer damping excursion (longer path over which the movements are braked) can be provided. Since, once a sufficient (typically virtually maximum) distance between the arcing contact pieces has been achieved early, the braking of the contact pieces can already begin since the distance between the contact pieces is kept constant by the 1:1 ratio. For a speed ratio v1/v2 which is close to one, the same in principle applies, but small changes in the distance between the contact pieces arise.

FIGS. 2 and 3 show the movements of the contact pieces 1, 2 only up to shortly after the onset of the damping. P1 denotes a first phase, during which, in the case of a movement in opposite directions of the two contact pieces 1, 2, a maximum relative speed v12 is present. In the case illustrated this is $v_{12,max} \approx 20$ m/s. P2 denotes a second phase, during which, in the case of a movement in the same direction of the two contact pieces 1, 2, a speed ratio v1/v2 of approximately 1:1 is present once the throat has been released. In FIGS. 2 and 3, the end of the second phase P2 coincides with the onset of the damping.

As can be seen in the right-hand part of FIG. 1 (in plan view), a lever 8 is mounted in rotatable fashion on the second contact piece 2 at a first end by means of a bolt 16. The lever 8 is mounted in rotatable fashion on a limb of an angled lever 9 by means of a bolt 17 at the second end of the lever 8. The second limb of the angled lever 9 is guided in a slotted-link disk 14 by means of a bolt 18. The angled lever 9 is mounted in rotatable fashion by means of a bolt 19, which is fixed in position and which is fixed, for example, to the housing of the heavy-duty circuit breaker. As symbolized by means of a line of action W, the movement of the slotted-link disk 14 is coupled (preferably rigidly) to the movement of the first contact piece 1.

The movement of the second contact piece 2 is therefore controlled via a lever mechanism by means of the slotted-link disk 14, which is connected to the drive. The gear 3 can convert a linear movement (of the drive) at a constant speed into a movement with movement direction reversal. A desired speed profile for the second contact piece 2 can be selected by suitably selecting the lever lengths and angles.

As is illustrated in FIG. 1, the gear 3 may be symmetrical, which results in a more favorable force distribution and increased stability.

The load of a damping device, which brakes the movement of the contact pieces, can be reduced by reducing the speed v2 of the second contact piece 2 at the end of the opening movement, since less kinetic energy needs to be absorbed.

The speed v1 of the first contact piece 1 after the initial acceleration may typically be between 3 m/s and 10 m/s, for example 5 m/s. The speed v2 of the second contact piece 2 may typically have a maximum of 10 m/s to 20 m/s, for example 15 m/s. The maximum speed ratio v1/v2 (in the case of a movement in opposite directions) may be between 1:2.4 and 1:3.5, for example 1:3. As a result, correspondingly high relative speeds v12 of between typically 15 m/s, 20 m/s and more can be reached which make rapid release of the throat 6 and efficient arc blowing possible by means of the provision of a high quenching gas pressure within a short period of time. A large distance between the contact pieces 1 and 2 (insulating path) can be achieved within a very short period of time.

Advantageously, the throat 6 and also the second contact piece 2 are essentially cylindrical. The diameter of the respective cylinder (of the throat or of the second contact piece) need not be completely constant and can vary slightly. Deviations from a circular cross section to, for example, elliptical cross sections are possible.

If the throat has a long length (large axial extent), a very large surface of the insulating nozzle can thus be subjected to the arc, as a result of which large quantities of material from the insulating nozzle can be vaporized, with the result that efficient arc blowing is achieved. In particular, throat lengths of more than 40 mm, advantageously more than 50 mm and more than 60 mm can be used.

A corresponding heavy-duty circuit breaker may be designed for rated short-circuit currents of over 40 kA or over 50 kA at rated voltages of over 170 kV or over 200 kV.

List of Reference Symbols

1 First arcing contact piece
2 Second arcing contact piece, blocking contact piece
3 Second drive, auxiliary drive, gear
4 Arc
5 Insulating nozzle
6 Throat
7 Channel, annular channel
8 Lever
9 Angled lever
10 Compression chamber
11 Heating chamber
12 Valve
13 Auxiliary nozzle
14 Slotted link, slotted-link disk
15 Piston
16, 17, 18 Bolts, rotational mounting
19 Fixed bolt, rotational mounting
21 Region, extended (in radius) region
A Axis, axis of symmetry
b, b' Parameter
d Distance
D Diameter, radial dimension
k Factor
P1 Phase
P2 Phase
v1 Speed of the first contact piece
v2 Speed of the second contact piece
v12 Relative speed of the contact pieces
$v_{12,c}$ Minimum relative speed of the contact pieces required for capacitive switching
$v_{12,max}$ Maximum relative speed of contact pieces
W Line of action
z Distance coordinate
z1 Direction
z2 Direction
α' Angle
α Opening angle

The invention claimed is:

1. A switching chamber for a heavy-duty circuit breaker which can be filled with a quenching gas, comprising:

rated current contact pieces;

a first arcing contact piece; and a second arcing contact piece, wherein the first and second arcing contact pieces are moveable, and a first drive for driving the first arcing contact piece; a second drive for driving the second arcing contact piece;

an arc which may burn between the arcing contact pieces;

a heating chamber for temporarily storing quenching gas heated by the arc, and an insulating nozzle, which has a throat, which is connected to the heating chamber, for guiding a quenching gas flow, wherein during an opening operation, a maximum relative speed $v_{12,max}$ of the two arcing contact pieces relative to one another is at least 1.3 times as great as a relative speed $v_{12,c}$ of the two arcing contact pieces which is required for capacitive switching, and wherein the first and second arcing contact pieces are moveable in at least the same direction.

2. The switching chamber as claimed in claim 1, wherein, during an opening operation, the maximum relative speed $v_{12,max}$ of the two arcing contact pieces relative to one another is at least 1.5 times as great as the relative speed $v_{12,c}$ of the two arcing contact pieces which is required for capacitive switching.

3. The switching chamber as claimed in claim 1, wherein, if it is installed in a single-chamber heavy-duty circuit breaker, the following applies for the maximum relative speed $v_{12,max}$ of the two arcing contact pieces relative to one another during an opening operation:

$$v_{12,max}>23\times U_N \cdot p \cdot f/(E_{crit} \cdot p_0), \text{ wherein}$$

$U_N$ is the rated voltage of the heavy-duty circuit breaker, p is the pole factor of the heavy-duty circuit breaker, $E_{crit}$ is the threshold field strength for discharges of the quenching gas, and $p_0$ is the filling pressure of the quenching gas, and f is the high-voltage system frequency for which the switching chamber is designed.

4. The switching chamber as claimed in claim 1, wherein the following applies for the maximum relative speed $v_{12,max}$ of the two arcing contact pieces relative to one another during an opening operation:

$$v_{12,max}>13 \text{ m/s},$$

in particular $v_{12,max}>17$ m/s.

5. The switching chamber as claimed in claim 1, wherein both arcing contact pieces are moveable, and in that, during a phase of movement in opposite directions of the arcing contact pieces a ratio v1/v2 of the speed v1 of the first arcing contact piece to the speed v2 of the second arcing contact piece of v1/v2≦1:2.4, in particular of v1/v2≦1:2.8, is achieved.

6. The switching chamber as claimed in claim 1, wherein a compression chamber is provided the volume of which is reduced during an opening operation.

7. The switching chamber as claimed in claim 6, wherein the compression chamber is different from the heating chamber and in that a valve is provided between the compression chamber and the heating chamber.

8. The switching chamber as claimed in claim 1, wherein the second drive can be driven by the first drive.

9. The switching chamber as claimed in claim 1, wherein the insulating nozzle can be driven by means of the first drive.

10. The switching chamber as claimed in claim 1, wherein, in a phase during a movement in the same direction of the arcing contact pieces the following applies for the ratio v1/v2 of the speed v1 of the first arcing contact piece to the speed v2 of the second arcing contact piece:

$$0.4 \geqq v1/v2 \geqq 1.2, \text{ in particular } 0.75 \geqq v1/v2 \geqq 1:1.15.$$

11. The switching chamber as claimed in claim 1, wherein, during an opening operation, after the contact separation and while a quenching gas flow along an axis through the throat in the direction of the second arcing contact piece is possible, a distance d, which is measured parallel to the axis between the throat and the second arcing contact piece is selected such that the flow rate of the quenching gas flow is at a maximum in a region which is arranged, with respect to the axis radially and laterally next to the second arcing contact piece and/or within the second arcing contact piece.

12. The switching chamber as claimed in claim 11, wherein the condition mentioned for the selection of the distance d is met during at least 10 ms, in particular during at least 35 ms.

13. The switching chamber as claimed in claim 1, wherein the second arcing contact piece is in the form of a pin.

14. The switching chamber as claimed in claim 1, wherein the throat can be blocked at least partially by one of the two arcing contact pieces which is referred to as the blocking contact piece and is moveable, and in that, during an opening operation, there is a time span during which a movement direction of the blocking contact piece remains unchanged and the maximum relative speed v12,max- of the two arcing contact pieces relative to one another is reached, and this time span lasts at least until the throat is no longer at least partially blocked by the blocking contact piece.

15. The switching chamber as claimed in claim 1, wherein the throat can be blocked at least partially by one of the two arcing contact pieces which is referred to as the blocking contact piece and is moveable, and in that, during an opening operation, a movement direction reversal of the at least one moveable arcing contact piece takes place, if the throat is no longer at least partially blocked by the blocking contact piece.

16. A heavy-duty circuit breaker, wherein the heavy-duty circuit breaker has at least one switching chamber as claimed in claim 1.

17. A method for opening a switching chamber for a heavy-duty circuit breaker which is filled with a quenching gas, the circuit breaker having rated current contact pieces, a first arcing contact piece and a second arcing contact piece having first and second drives, respectively, and an insulating nozzle which has a throat, the method comprising:

moving the first arcing contact piece via the first drive;

moving the second arcing contact piece via the second drive;

burning an arc between the first and second arcing contact pieces such that arc quenching gas is heated;

temporarily storing the heated quenching gas and guiding the heated quenching gas through the throat for blowing the arc, during a first phase, reaching a maximum relative speed $v_{12,max}$ of the first and second arcing contact pieces in relation to one another, the maximum relative speed $v_{12,max}$ being at least 1.3 times as great as a relative speed $v_{12,c}$ of the first and second arcing contact pieces, the relative speed $v_{12,c}$ being required for capacitive switching; and during a second phase, moving the first and second arcing contact pieces in the same direction.

18. A switching chamber for a heavy-duty circuit breaker which is filled with a quenching gas, having rated current contact pieces, a first arcing contact piece and a second arcing contact piece are provided, of which both are moveable and movable in the same direction in a phase during the movement, having an arc which may burn between the arcing contact pieces, having a heating chamber for temporarily storing quenching gas heated by the arc, and having an insulating nozzle, which has a throat, which is connected to the heating chamber, for guiding a quenching gas flow, wherein, during an opening operation, a maximum relative speed $v_{12,max}$ of the two arcing contact pieces relative to one another is at least 1.3 times as great as a relative speed $v_{12,c}$ of the two arcing contact pieces which is required for capacitive switching.

19. The circuit breaker as claimed in claim 16, wherein the circuit breaker is designed for rated voltages of at least 72 kV.

20. The circuit breaker as claimed in claim 19, wherein the circuit breaker is designed for rated short-circuit currents of over 40 kA and for rated voltages of over 170 kV.

21. The method as claimed in claim 17, wherein during the second phase, moving the first and second arcing contact pieces in the same direction at a speed ratio between 0.9 and 1.1.

* * * * *